US006216965B1

(12) United States Patent
Chao

(10) Patent No.: US 6,216,965 B1
(45) Date of Patent: Apr. 17, 2001

(54) NOZZLE OF WATER SPRINKLER

(76) Inventor: Hui-Chen Chao, 75, Liau Tsuo Hsiang, Liau Tsuo Li Lu Kang Chen, Chan Hua Hsien (TW)

( * ) Notice: Subject to any disclaimer, the term of this patent is extended or adjusted under 35 U.S.C. 154(b) by 0 days.

(21) Appl. No.: 09/677,747

(22) Filed: Oct. 3, 2000

(51) Int. Cl.[7] ..... B05B 15/08

(52) U.S. Cl. ..... 239/587.4; 239/280; 239/280.5; 239/281; 239/530; 239/532; 239/587.3

(58) Field of Search ..... 239/280, 280.5, 239/281, 525, 530, 532, 587.1, 587.3, 587.4

(56) References Cited

U.S. PATENT DOCUMENTS 1,597,477 * 8/1926 Panhorst ..... 239/587.4 X
2,044,445 * 6/1936 Price et al. ..... 239/587.4 X
2,257,585 * 9/1941 Auvil ..... 239/532
2,776,168 * 1/1957 Schweda ..... 239/587.4
3,236,455 * 2/1966 Lewis et al. ..... 239/280
3,915,382 * 10/1975 Davis ..... 239/281

* cited by examiner

*Primary Examiner*—David A. Scherbel
*Assistant Examiner*—Robin O. Evans
(74) *Attorney, Agent, or Firm*—Harrison & Egbert

(57) ABSTRACT

A sprinkler nozzle including a grip which is fastened to an outer pipe. An inner pipe is received in the outer pipe such that the inner pipe can be extracted or retracted in conjunction with a control member. The outer pipe is provided at the top end with a pivoting member for fastening rotatably a head through which water is emitted in a specific direction.

1 Claim, 7 Drawing Sheets

NOZZLE OF WATER SPRINKLER

BACKGROUND OF THE INVENTION

1. Field of the Invention

The present invention relates generally to a water sprinkler, and more particularly to a nozzle of the water sprinkler.

2. Description of Related Art

As shown in FIG. 1, a prior art nozzle 10 of the sprinkler comprises a pipe 11 which is fastened at one end with a head 12, and at another end to a grip 13. The prior art nozzle 10 is defective in design because the pipe 11 cannot be adjusted in length, and because the head 12 is fixedly fastened to the pipe 11. In other words, the prior art nozzle 10 has a fixed length, thereby making it costly to store or ship the prior art nozzle 10.

BRIEF SUMMARY OF THE INVENTION

The primary objective of the present invention is to provide a sprinkler with a nozzle which is free of the shortcomings of the prior art nozzle described above.

In keeping with the principle of the present invention, the foregoing objective of the present invention is attained by an improved nozzle which comprises a head, an expandable pipe, and a grip. The head is rotatably fastened to one end of the expandable pipe, whereas the grip is fastened to the other end of the expandable pipe.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
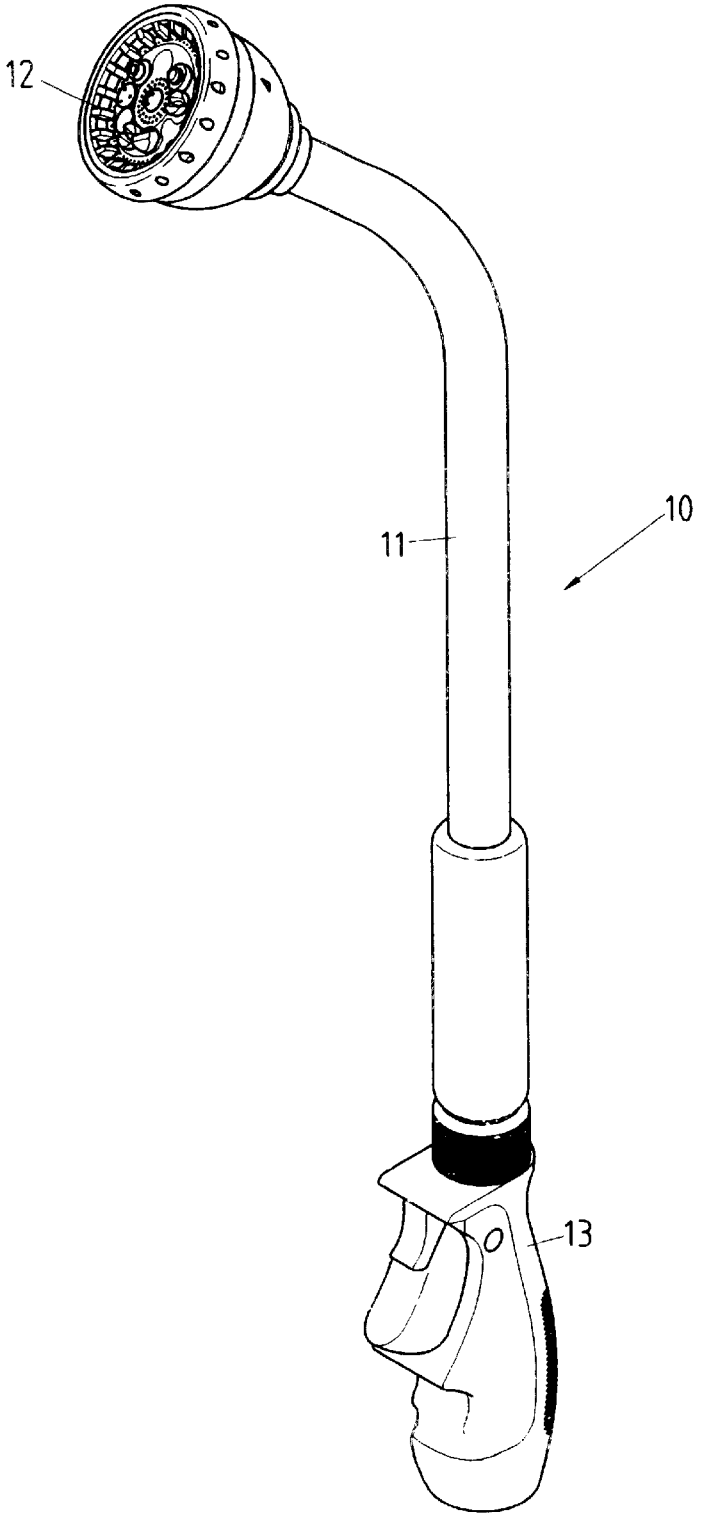
FIG. 1 PRIOR ART
FIG. 1 shows a perspective view of a sprinkler nozzle of the prior art.
Figure 2:
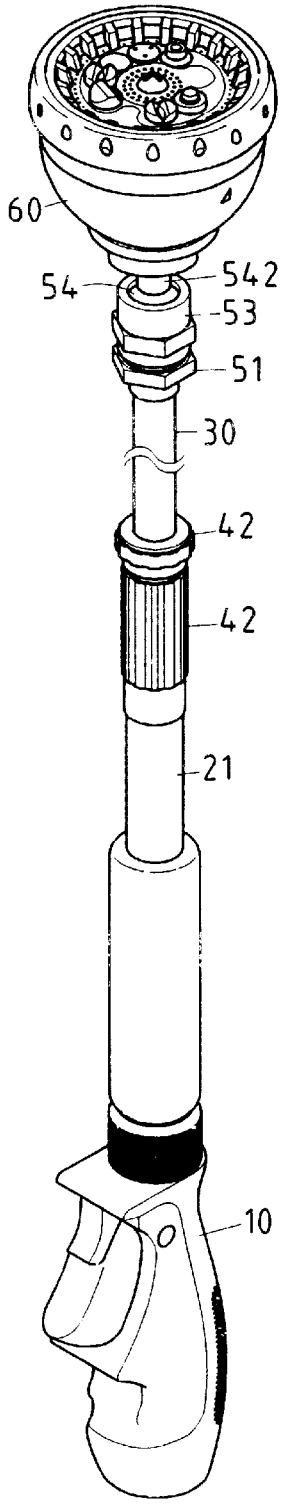
FIG. 2 shows a perspective view of a sprinkler nozzle of the preferred embodiment of the present invention.
Figure 3:
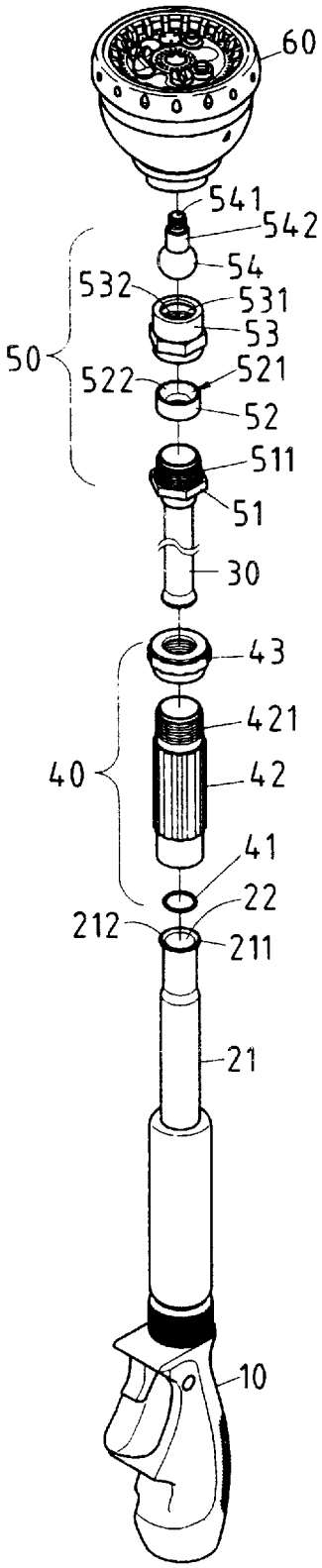
FIG. 3 shows an exploded view of the preferred embodiment of the present invention.
Figure 4:
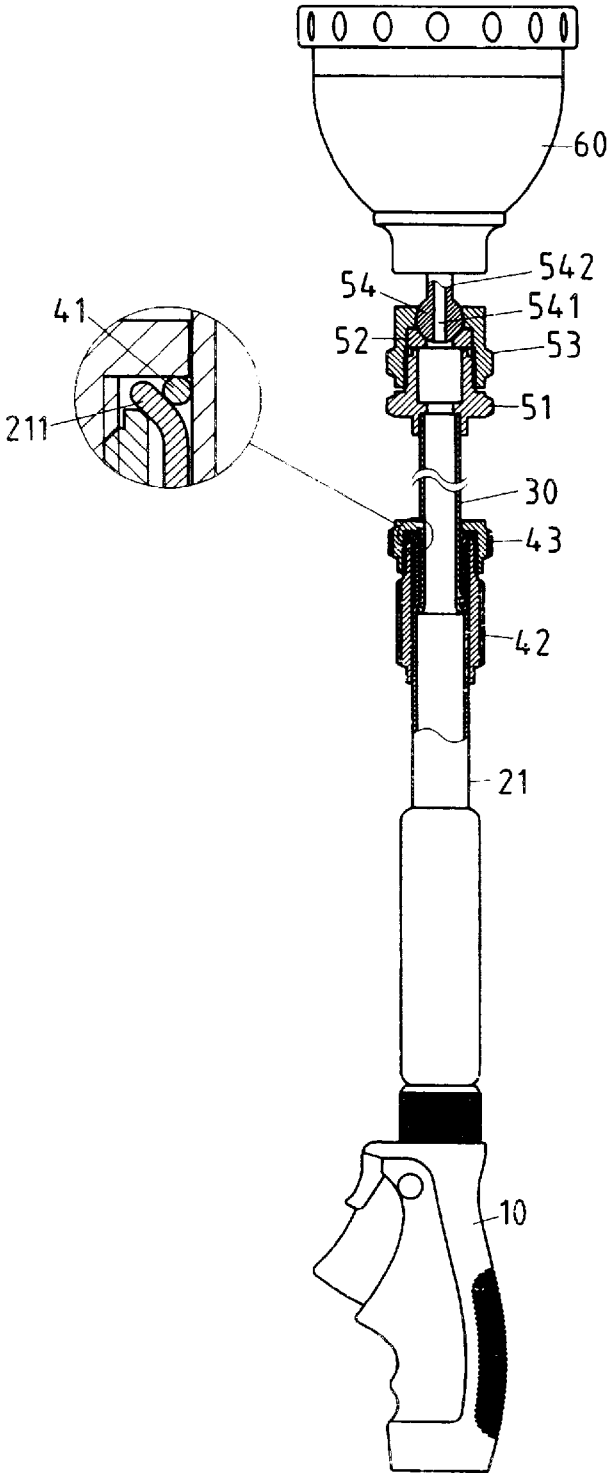
FIG. 4 shows a sectional view of the preferred embodiment of the present invention.
Figure 5:
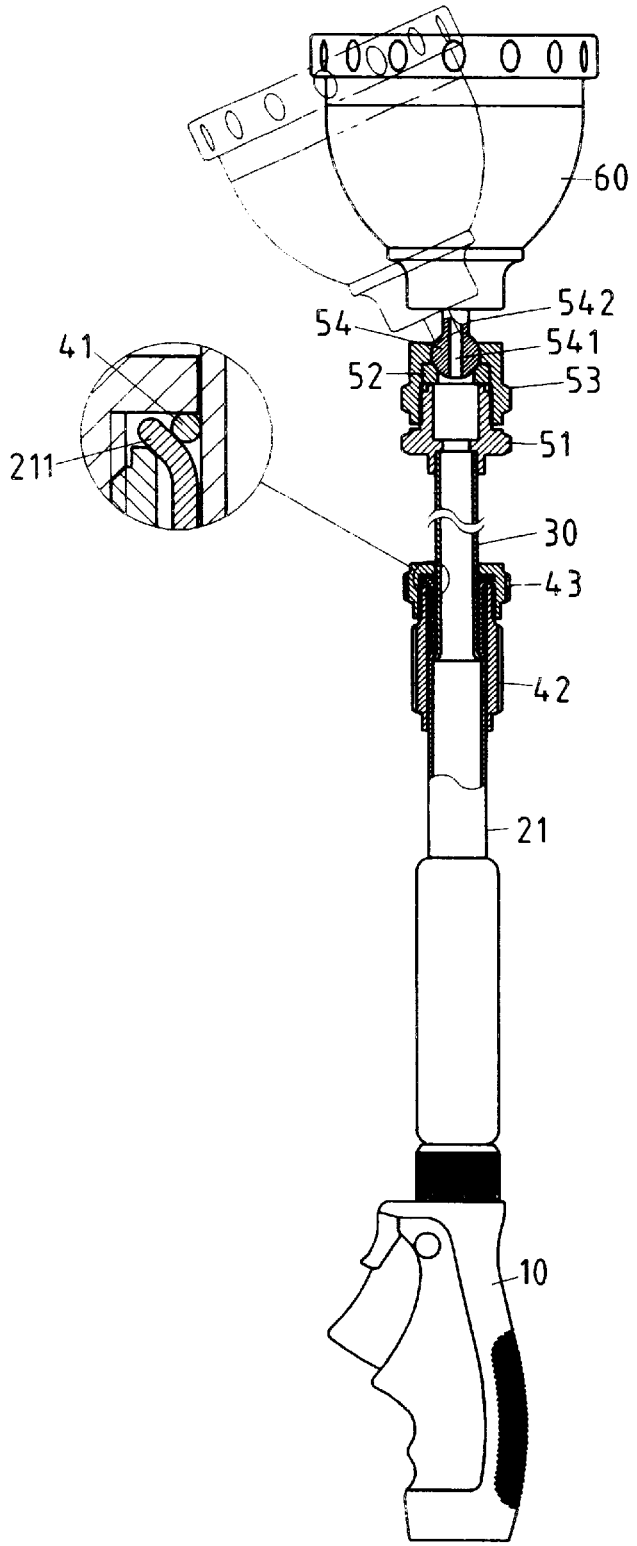
FIG. 5 shows a schematic view of the adjustment of the head of the preferred embodiment of the present invention.
Figure 6:
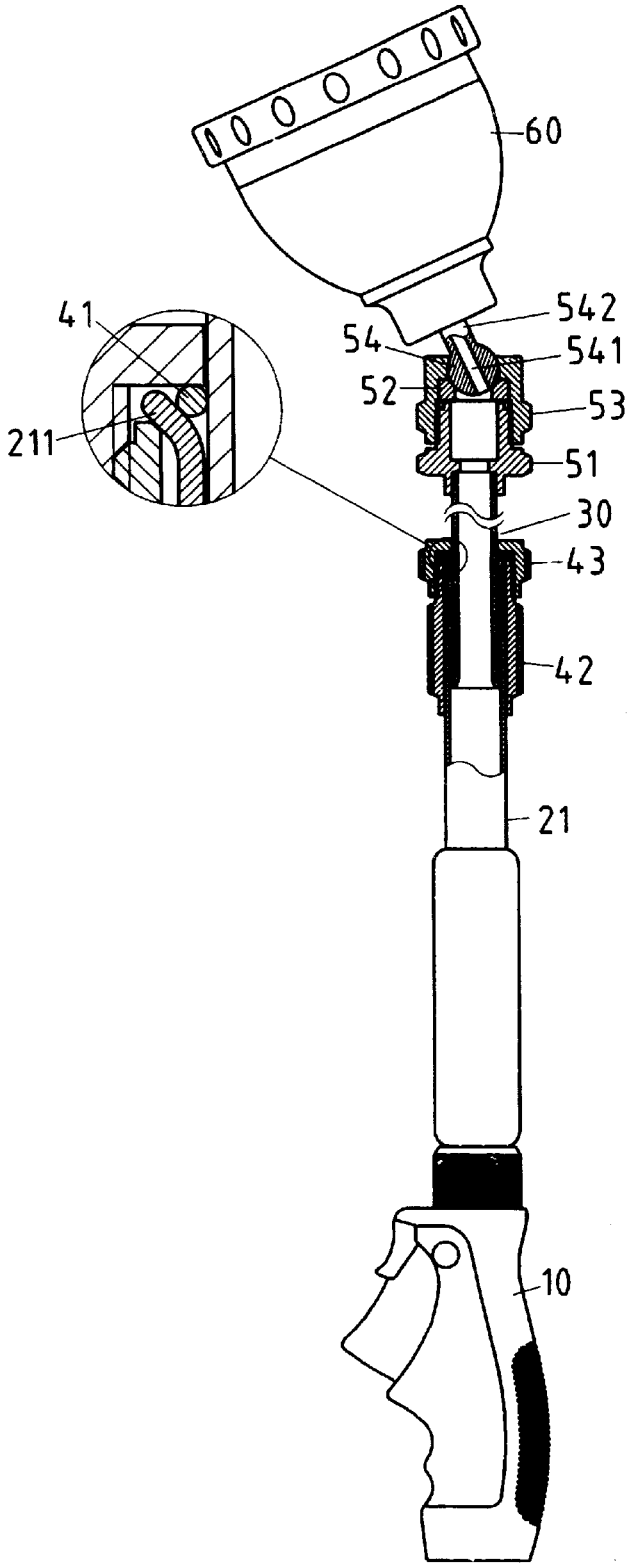
FIG. 6 shows a sectional schematic view of the position head of the preferred embodiment of the present invention.
Figure 7:
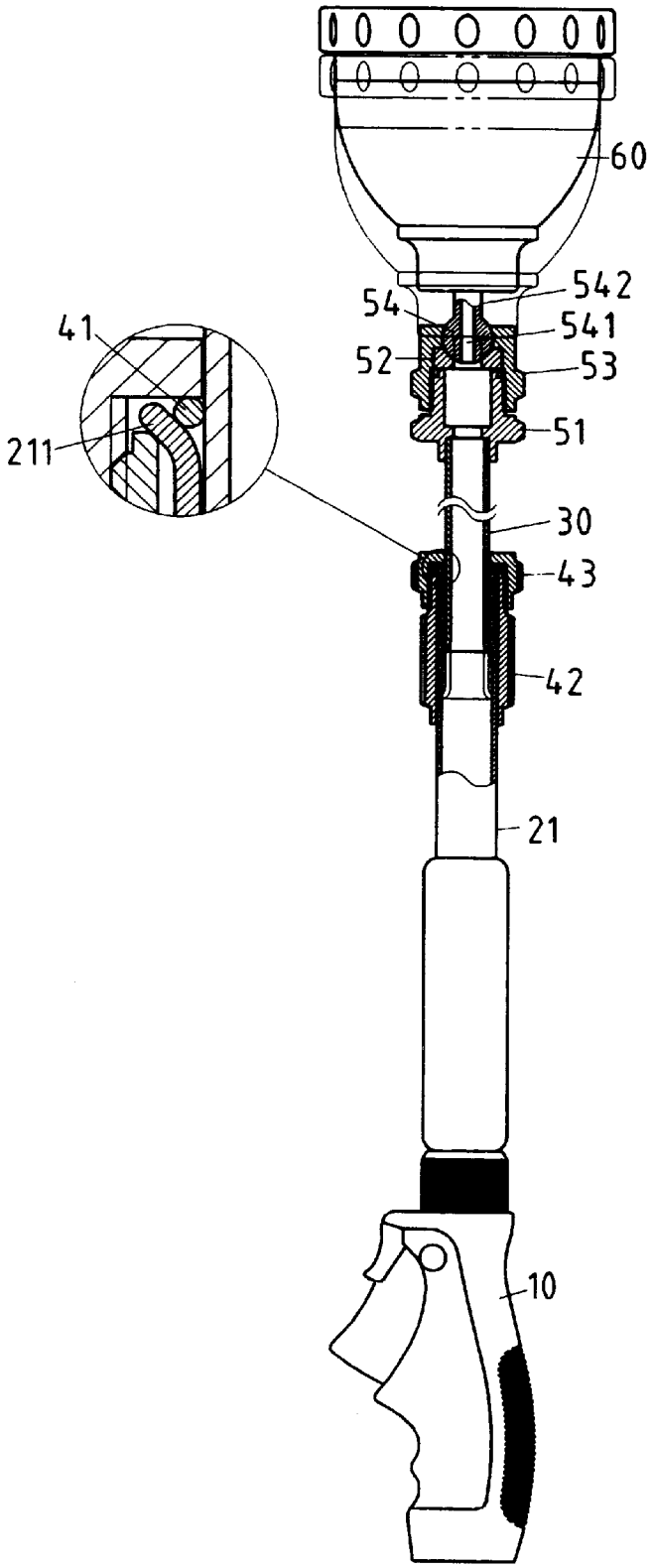
FIG. 7 shows a sectional schematic view of the length adjustment of the preferred embodiment of the present invention.

As shown in FIGS. 2–7, a sprinkler nozzle of the preferred embodiment of the present invention comprises a grip 10, an inner pipe 30, a control member 40, a pivoting member 50, and a head 60.

The grip 10 is fastened at one end to an outer pipe 21 which is provided at the free end with an opening 22. The edge of the opening 22 is provided with a flange 211. The flange 211 is provided with a tapered annular edge 212.

The inner pipe 30 is received in the interior of the outer pipe 21 such that the top end of the inner pipe 30 juts out of the outer pipe 21 via the opening 22 of the outer pipe 21.

The control member 40 is formed of a washer 41, a tubular body 42, and a threaded ring 43. The washer 41 is disposed on the tapered annular edge 212. The tubular body 42 is fitted over the top end of the outer pipe 21 and is provided at the top end with outer threads 421. The threaded ring 43 is fitted over the inner pipe 30 such that the threaded ring 43 is engaged with the outer threads 421 of the tubular body 42, and such that the threaded ring 43 exerts a pressure on the washer 41 so as to securely lock the inner pipe 30.

The pivoting member 50 is formed of a connector 51, a leakproof pad 52, a locating pipe 53, and a spherical connector 54. The connector 51 is fastened to the inner pipe 30 and is provided with outer threads 511. The leakproof pad 52 is provided with a center through hole 521 and an arcuate groove 522. The leakproof pad 52 is located at the top of the connector 51. The locating pipe 53 is provided with a center through hole 531 and inner threads 532. The spherical connector 54 is provided in the center with a water inlet 541, and at the top end with a threaded pipe 542 of an appropriate length. The spherical connector 54 is received in the locating pipe 53 such that the outer wall of the spherical connector 54 is in an intimate contact with the inner wall of the through hole 531 of the locating pipe 53, and such that the threaded pipe 542 is juts out of the top end of the locating pipe 53. In the meantime, the locating pipe 53 is engaged with the top end of the connector 51. The spherical connector 54 is in intimate contact with the arcuate groove 522 of the leakproof pad 52.

The head 60 is fastened to the threaded pipe 542 of the spherical connector 54. The head 60 is rotatably fastened to the pivoting member 50 by means of the spherical connector 54. As the threaded ring 43 of the control member 40 is unfastened, the inner pipe 30 is relieved of the pressure of the washer 41 and can be thus adjusted in length in conjunction with the outer pipe 21. Upon having adjusted the length, the threaded ring 43 is once again fastened to the tubular body 42, thereby causing the threaded ring 43 to press against the washer 41 which is forced into the tapered annular edge 212 of the outer pipe 21 to press against the outer wall of the inner pipe 30. The inner pipe 30 is thus locked in position.

In view of the fact that the head 60, the outer pipe 21, and the inner pipe 30 of the present invention are adjustable, the sprinkler nozzle of the present invention can be economically packaged for storage or shipment.

I claim:

1. A sprinkler nozzle comprising:

a grip;

an outer pipe fastened at one end to said grip and provided at another end with an opening having a flange, said flange being provided with a tapered annular edge;

an inner pipe received in said outer pipe such that a top end of said inner pipe juts out of said outer pipe via said opening of said outer pipe;

a control member comprised of a washer, a tubular body, and a threaded ring, said washer being disposed on said tapered annular edge of said flange of said outer pipe, said tubular body being fitted over said outer pipe and provided with outer threads, said threaded ring being fitted over said inner pipe such that said threaded ring is engaged with said outer threads of said tubular body, and that said threaded ring exerts a pressure on said washer;

a pivoting member comprised of a connector, a leakproof pad, a locating pipe, and a spherical connector, said connector being fastened to said inner pipe and provided with outer threads, said leakproof pad being provided with a center through hole and an arcuate groove, said leakproof pad being disposed at a top of said connector, said locating pipe being provided with a center through hole and inner threads, said spherical connector being provided with a water inlet and a threaded pipe fastened thereto, said spherical connector being disposed in said locating pipe such that said spherical connector is in intimate contact with an inner wall of said center through hole of said locating pipe, and that said threaded pipe juts out of said locating pipe, and further that said spherical connector is in intimate contact to said arcuate groove of said leakproof pad; and a head fastened pivotally with said pivoting member in conjunction with said spherical connector.

* * * * *